United States Patent [19]

Kerwin

[11] Patent Number: 4,973,885

[45] Date of Patent: Nov. 27, 1990

[54] LOW VOLTAGE DIRECT CURRENT (DC) POWERED FLUORESCENT LAMP

[75] Inventor: Richard G. Kerwin, Prospect Heights, Ill.

[73] Assignee: Davis Controls Corporation, Rolling Meadows, Ill.

[21] Appl. No.: 335,432

[22] Filed: Apr. 10, 1989

[51] Int. Cl.[5] ..... H05B 41/36

[52] U.S. Cl. ..... 315/219; 315/209 R; 315/DIG. 7

[58] Field of Search ..... 315/209 R, 219, DIG. 7, 315/220, 221, 224, 94, DIG. 5

[56] References Cited

U.S. PATENT DOCUMENTS 4,145,636 3/1979 Doi ..... 315/219

*Primary Examiner*—Eugene R. LaRoche
*Assistant Examiner*—Ali Meyzari
*Attorney, Agent, or Firm*—Robert J. Black

[57] ABSTRACT

A lighting device using a fluorescent lamp adapted to be powered from a low voltage direct current source. Operation of the lamp is facilitated by the inclusion of a stabilized blocking oscillator circuit which provides high voltage alternating current for ignition and operation of the lamp as well as power for operating the filamentary heaters when included in the lamp. Operation at a very high frequency improves the efficiency of the fluorescent lamp, thus providing greater light output.

14 Claims, 2 Drawing Sheets

LOW VOLTAGE DIRECT CURRENT (DC) POWERED FLUORESCENT LAMP

BACKGROUND OF THE INVENTION

1. Field of the Invention

The present invention relates to fluorescent lamps, and, more particularly, to a fluorescent lamp adapted for powering by a low voltage direct current source, such as a battery, to facilitate portable operation.

2. Background Art

Electronic circuitry to convert low voltage direct current power into alternating current at voltages suitable for firing and maintaining the mercury vapor plasma as contained within conventional fluorescent lamps has previously been accomplished. However, such devices have frequently been less than effective inasmuch as it is frequently necessary in such an arrangement to provide an excess or high voltage to strike the arc initially. The requirement of this voltage is particularly important when the fluorescent lamp is initially in a cold state. Such a condition is aggravated of course if the lamp has been stored or operated outside in cold climate areas. Thus this requirement for excess or high voltage to obviate the above problem causes devices of conventional construction to be designed somewhat inefficiently. Accordingly, it is the object of the present invention to provide a new and more improved form of electronic circuit capable of operating fluorescent lamps over a wide range of temperatures.

SUMMARY OF THE INVENTION

The present invention consists of a blocking oscillator circuit, consisting of a transistor, a three winding blocking transformer, a blocking capacitor, and a frequency determining resistor adapted for connection to a low voltage DC power source. Also included are a stabilizing diode which acts to stabilize the frequency of operation for changing loads while allowing more AC current to be available for preheating of fluorescent lamp filamentary heaters. A polarity protective diode prevents damage from an inadvertent misconnection of the power supply polarity, or in an alternative embodiment, a full diode bridge provides for operation regardless of polarity connection. A large capacitor, connected across the input of the circuit, provides filtering of the supply power to prevent interference to any noise sensitive devices that may be connected to the same power source.

In the present invention, circuitry is also included by means of which one or both of the filamentary heaters found in many conventional fluorescent lamps can be heated previous to the striking of the arc with substantial reduction of the heater power after the arc has been struck. The present circuitry is so designed as to be able to power fluorescent lamps of greatly dissimilar sizes without changing the majority of the components. Most traditional blocking oscillators are strongly load dependent insofar as operating frequency is concerned. This condition exists because reverse voltage available to block the oscillating transistor changes as the load is changed. Thus the recovery time of the circuit, and therefore its operating frequency, is determined by the RC time constant employed and the voltage impressed across the circuit. In the present invention, to provide for a stable blocking voltage, and thus the maintenance of a stable operating frequency, a diode is placed across the emitter-base junction of the oscillating transistor, in reverse to that of normal emitter-base conduction. This diode prevents excess blocking voltages, which are load dependent, from appearing at this point and provides for much more stable frequency operation in response to any change in load. Furthermore, in addition this diode allows base drive current to be fully utilized to heat one or both ends of the fluorescent lamp. Obviously this feature could be ignored if the fluorescent lamp employed did not have the necessary preheating filaments associated with its input electrodes.

The use of high frequency alternating current to excite the phosphor in a fluorescent lamp is also known to improve the lamp's efficiency as to regard to lumen output versus wattage input. The full advantage of this feature is taken and improvements in the nature of approximately 10% in light output having been measured. The utilization of high frequency alternating current also presents the possibility of utilizing capacitive rather than inductive ballasting for the fluorescent lamp. Thus the use of capacitive ballasting provides for the incorporation of another unique feature. This feature is the ability to dim the lamp. Dimming is achieved by changing the frequency of the oscillating transistor or by changing the capacitive reactance of the ballast capacitor. A larger ballast capacitor has less reactance, thus the more alternating current flows the brighter the lamp becomes. In order to utilize the operating frequency for control of brightness, the value of the blocking capacitor may be changed. In this case, a larger value provides for a lower frequency, thus the ballast capacitor represents a large reactance and less current flows through the lamp. Thus the lessor amount of current renders the lamp operable on a dimmer basis.

DESCRIPTION OF THE PREFERRED EMBODIMENT

Figure 1:
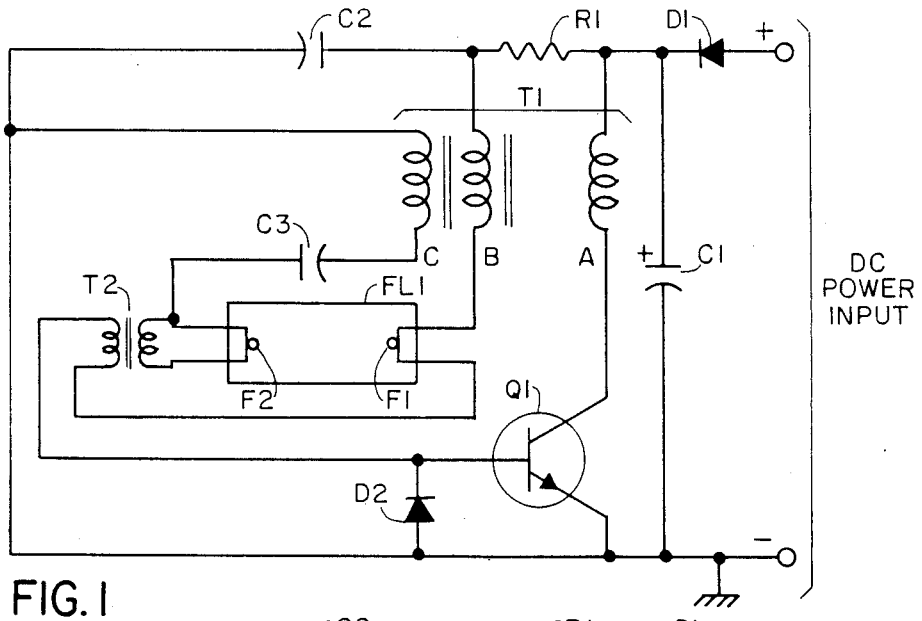
FIG. 1 is a schematic diagram of a circuit for igniting and operating a fluorescent lamp from a low voltage direct current source, including circuitry of powering the filamentary heaters associated with both electrodes of a fluorescent lamp so equipped.

Referring now to FIG. 1, the DC circuitry of the present invention is shown, including the connections to a fluorescent lamp FL1. The circuit is connected to a low voltage source of DC power input, such as a battery, at terminals + and −. Typical operation input power source could be a 12 or 24 volt battery. However, the use of other power sources is not to be negated.

The circuit included is basically that of a blocking oscillator, including an NPN transistor Q1 equipped with the usual base, emitter and collector electrodes. A special transformer T1 is shown having a first winding A connected to the collector of transistor Q1 and connected through diode D1 to terminal + for DC power input. A second, or feedback winding B is connected through frequency determining resistor R1 and polarity protector diode D1 to terminal + with the other end of the winding B being connected to the filamentary heater F1 associated with the fluorescent lamp FL1 and then extending through the primary winding of transformer TR2 to the base electrode of transistor Q1.

High voltage winding C is coupled from the junction of resistor R1 and feedback winding B through capacitor C2 and from there the winding C is coupled through capacitor C3 to the electrode F2 of fluorescent lamp FL1.

Capacitor C1 acts as a filter across the input of the present circuitry. Capacitor C2 is a blocking capacitor associated with the blocking oscillator circuitry as will be hereinafter described, and capacitor C3 is a current limiting ballast capacitor. Diode D1 prevents damage from an inadvertent misconnection of the power supply polarity and diode D2 across the emitter-base junction of transistor Q1 stabilizes the frequency of operation.

When the DC power source is initially applied at terminals + and −, current will flow through resistor R1 to and through the feedback winding B of blocking transformer TI, through the filamentary heater associated with electrode F1 of fluorescent FL1, on through the input winding of secondary transformer TR2 and thus into the base of the oscillating transistor Q1 which at this point in time is not in the oscillating mode. This initial application of current causes a much greater current to flow in the collector winding A of the block transformer TI and this current is then coupled into the feedback winding B of transformer TI, continues to increase regeneratively until the transistor Q1 becomes fully saturated. When no further current increase is possible, the transformer action collapses and reverse polarities of voltage and current appear at the base of transistor Q1. This action turns transistor Q1 off sharply and completely. Thus, the transistor is blocked for current flow and thus derives the conventional name of the included circuit, that of being a "blocking oscillator".

The above sequence of operation repeats many times each second, the frequency of which is determined mainly by the characteristics of transformer TI, resistor R1, and blocking capacitor C2. Diode D2, located across transistor Q1's emitter-base junction, assists in stabilizing the frequency of operation of the oscillator in response to the changing of loads and further allows more alternating current flow to be available for preheating the fluorescent lamp FL1 filamentary heaters associated with electrodes F1 and F2. A third winding C of transformer TI presents a high voltage, which through the current limiting ballast capacitor C3 provides the necessary voltage and current suitable for starting or igniting and operating fluorescent lamp FL1.

Figure 4:
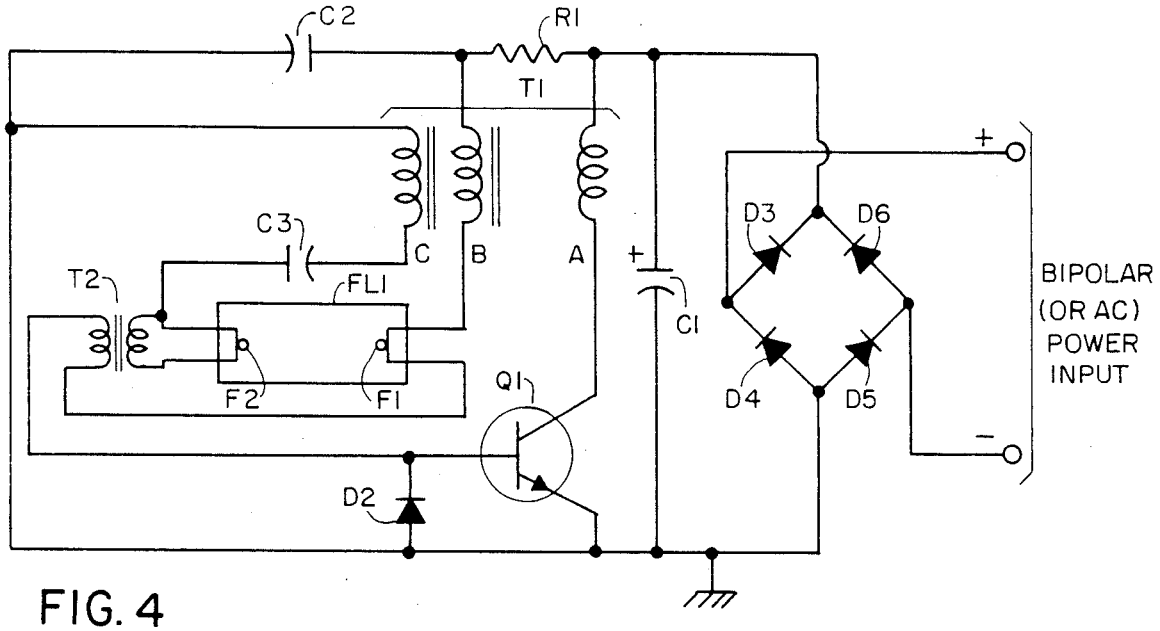
FIG. 4 is a schematic circuit diagram of a circuit adapted to power a fluorescent lamp from a low voltage direct current source similar to that shown in FIG. 1, except that a diode bridge circuit is included in the circuit's input to render the circuit action independent of the polarity connection to the DC power source.

The inclusion of diode D1 prevents damage from the inadvertent misconnection of the power supply polarity. The diode bridge circuit, consisting of diodes D3, D4, D5 and D6, as shown in FIG. 4, provides for operation of the included circuitry regardless of the polarity of the connection to the associated power input. It also facilitates operation by connection to an alternating current source. Capacitor C1 is relatively large in value and provides filtering of the DC power supply, to which the included circuitry is attached, to prevent any interference to any noise sensitive devices which may be connected to the same power source.

As shown in FIG. 1, transformer TR2 provides the necessary power to heat the filamentary heater associated with electrode F2 of fluorescent lamp FL1.

Figure 2:
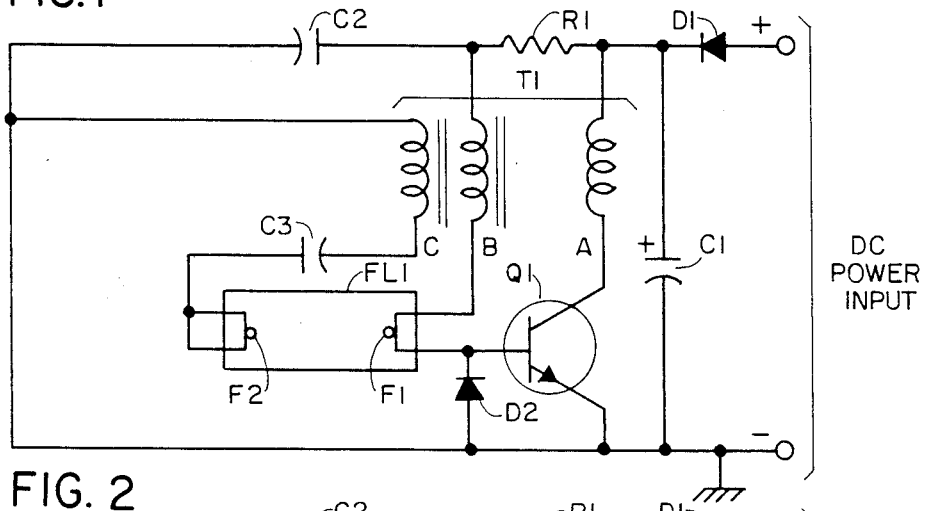
FIG. 2 is a schematic circuit diagram adapted for the ignition and operation of a fluorescent lamp from a low voltage direct current source and including means for powering one of the filamentary heaters associated with the electrodes of a fluorescent lamp.
Figure 3:
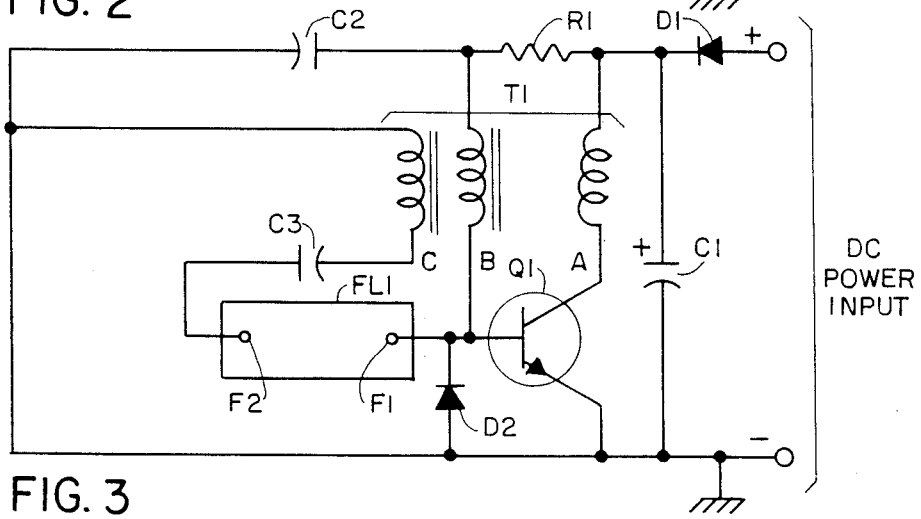
FIG. 3 is a schematic circuit diagram adapted to ignite and power a fluorescent lamp from a direct current low voltage source wherein no filamentary heaters are included with the electrodes of the fluorescent lamp.

Should the requirement for heating be less than that provided for in the circuit of FIG. 1, the circuit of FIG. 2 may be employed in which only one filamentary heater, that is the one associated with electrode F1 of fluorescent lamp FL1, is provided with the necessary current to provide the heating. If instant start fluorescent lamps are employed for fluorescent lamp FL1, no preheating is required and the circuitry as disclosed in FIG. 3 would be appropriate.

Figure 5:
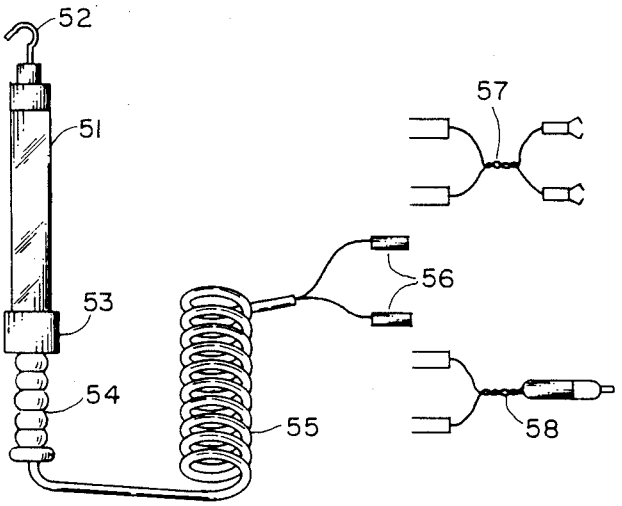
FIG. 5 is a pictorial representation of a fluorescent lamp with a socket and handle including the circuit of the present invention which facilitates operation of a lamp on a portable basis.

Referring now to FIG. 5, a practical embodiment of a lamp emboding the principals of the present invention as shown, consisting of fluorescent lamp 51, including a hanging hook mounted on one end thereof 52, with the other end being mounted in base 53 attached to handle 54. The circuitry like that described in FIGS. 1-4, or circuitry similar thereto, is included in the handle 54 with connection to a direct current power source being made through cord 55 which terminates in connectors 56. Connectors 56 facilitate connection to the adapter arrangement 57 which includes clamps for a direct connection to a batter or similar device, or to the apparatus 58 which would adapt the unit for connection into an automotive cigar lighter, or similar unit.

While but a single embodiment of the present invention has been shown, it will be obvious to those skilled in the art that numerous modifications can be made without departing from the spirit of the invention which shall be limited only by scope of the claims appended hereto.

What is claimed is:

1. A lighting device adapted for operation from a low voltage direct current source comprising:

a fluorescent lamp, including first and second electrodes;

first and second DC powered input terminals;

a blocking oscillator circuit including an oscillator transistor having first, second and third electrodes;

said transistor first electrode connected to said fluorescent lamp first electrode;

said transistor second electrode connected to said second DC power input terminal;

a blocking transformer, including a first winding connected between said first DC power input terminal and said transistor third electrode;

a feedback winding connected in series with a frequency determining resistor between said transistor first electrode and said first DC power input terminal;

and said blocking transformer further including a high voltage winding connected in series with a blocking capacitor between said first DC power input terminal and said fluorescent lamp second electrode;

said blocking capacitor and said high voltage winding also including a circuit connection to said second DC power input terminal;

said oscillator circuit operated in response to the connection of said DC power input terminal to a low voltage DC source to produce a high voltage alternating current to ignite and power said flourescent lamp to produce light.

2. A lighting device as claimed in claim 1 wherein: there is further included a stabilizing diode connected between said second DC power input terminal and said transistor first electrode to stabilize the frequency of operation of changing loads.

3. A lighting device as claimed in claim 1 wherein: there is further included a filter capacitor connected between said first and second DC power input terminals to prevent interference to noise sensitive devices connected to said DC power source.

4. A lighting device as claimed in claim 1 wherein: there is further included a diode between said first DC power input terminal and said blocking transformer first winding, operated to prevent damage from inadvertent misconnection of the polarity of said DC power source.

5. A lighting device as claimed in claim 1 wherein: there is further included a diode bridge circuit, including input terminals connected to said first and second DC power input terminals and output terminals, a first output terminal connected to said first winding and a second output terminal connected to said transistor second electrode;

operated to permit operation regardless of the connection of polarity to said DC power source.

6. A lighting device as claimed in claim 1 wherein: there is further included a current limiting ballast capacitor connected between said high voltage winding and said fluorescent lamp second electrode.

7. A lighting device as claimed in claim 1 wherein: there is further included a filamentary heater associated with each of said fluorescent lamp electrodes; said filamentary heater associated with said first fluorescent lamp electrode connected in series between said blocking transformer first winding and said transistor first electrode.

8. A lighting device as claimed in claim 1 wherein: there is further included a filamentary heater associated with each of said fluorscent lamp electrodes.

9. A lighting device as claimed in claim 8 wherein: there is further included a filamentary heater transformer, including a first winding included in the circuit connection between said filamentary heater associated with said first fluorescent lamp electrode and said transistor first electrode and a second winding connected to said filamentary heater associated with said fluorescent lamp second electrode whereby preheating of said fluorescent lamp is provided to facilitate ignition of said fluorescent lamp.

10. A lighting device as claimed in claim 1 wherein: said transistor first electrode is a base electrode.

11. A lighting device as claimed in claim 1 wherein: said transistor second electrode is an emitter electrode.

12. A lighting device as claimed in claim 1 wherein: said transistor third electrode is a collector electrode.

13. A lighting device as claimed in claim 1 wherein: said blocking transformer further includes a winding to provide preheating of said fluorescent lamp first electrode.

14. A lighting device as claimed in claim 1 wherein: said oscillator transistor is of the NPN type.

* * * * *